US007024802B2

(12) United States Patent
Myung

(10) Patent No.: US 7,024,802 B2
(45) Date of Patent: Apr. 11, 2006

(54) AIR FLOW STRUCTURE OF DRYER

(75) Inventor: Hwan Joo Myung, Suwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/012,204

(22) Filed: Dec. 16, 2004

(65) Prior Publication Data

US 2005/0132600 A1 Jun. 23, 2005

(30) Foreign Application Priority Data

Dec. 19, 2003 (KR) ..... 10-2003-0093678

(51) Int. Cl.
*F26B 21/06* (2006.01)

(52) U.S. Cl. ..... 34/604

(58) Field of Classification Search ..... 34/596, 34/600, 601, 602, 603, 604
See application file for complete search history.

(56) References Cited

U.S. PATENT DOCUMENTS 2,451,206 A * 10/1948 Ellis ..... 34/604
2,908,086 A * 10/1959 Fuhring ..... 34/604
5,159,766 A * 11/1992 Henig ..... 34/77
6,199,296 B1 * 3/2001 Jewitt ..... 34/115
6,755,278 B1 * 6/2004 Huhn et al. ..... 181/202

FOREIGN PATENT DOCUMENTS

JP 60-96298 * 5/1985

* cited by examiner

*Primary Examiner*—S. Gravini
(74) *Attorney, Agent, or Firm*—Birch, Stewart, Kolasch & Birch, LLP

(57) ABSTRACT

Provided is an air flow structure for a dryer, which includes a drying fan, and an air guide having a bent and inclined shape so as to guide flow of a circulation air discharged by the drying fan. This air flow structure improves air circulation flow in the dryer, reduces noise generated in the drying procedure, and increases air volume introduced into a drying duct.

20 Claims, 8 Drawing Sheets

AIR FLOW STRUCTURE OF DRYER

BACKGROUND OF THE INVENTION

1. Field of the Invention

The present invention relates to a dryer, and more particularly to an air flow structure of a dryer having an improved drying duct so as to reduce noise caused by circulation air in the drying duct by guiding the circulation air inhaled by a drying fan in a predetermined direction within the drying duct.

2. Description of the Related Art

Generally, a dryer is a household appliance for completely eliminating moisture penetrated into the laundry that is already washed and dehydrated. This dryer is classified into a condensation dryer in which air in a drum is flowed again into the drum via a condenser and a heater so that the air in the drum is not discharged out but circulated in the dryer; and a ventilation dryer in which air in a drum is discharged out after moisture is removed while the air is passing through a condenser.

In more detail, in case of the condensation dryer, the air that circulates in the dryer absorbs moisture penetrated in the laundry within the drum, and then temperature of the air is lowered by means of heat exchange while the air is passing through the condenser. In addition, with the temperature lowered, moisture contained in the air is condensed. The condensation water is pumped by means of a condensation pump, and then finally discharged out.

Meanwhile, the ventilation dryer is configured so that the hot and humid air absorbing moisture from the laundry in the drum is discharged out of the dryer via a lint filter.

However, the condensation dryer and the ventilation dryer are identical to each other in the point that the laundry received in the drum is repeatedly ascended and descended by rotation of the drum and thus actively exchanges heat with hot and dry air in the drum.

In addition, in case of the condensation dryer, there are needed a drying fan for circulating the air discharged from the drum in the dryer, an air guide means for guiding flow of the air discharged from the drying fan, and a drying duct acting as a flow duct of the air discharged from the drying fan.

Here, an air guide that is a related art air guide means formed along the circumference of the drying fan is made of metal plate and formed to wrap the entire drying fan, so serious noise is generated when the circulation air moves along the air guide.

In addition, the air guide requires a size as great as being capable of wrapping the entire drying fan, thereby increasing manufacture costs.

SUMMARY OF THE INVENTION

The present invention is proposed to solve the problems of the prior art, and therefore an object of the invention is to provide an air flow structure of a dryer, which may decrease noise and reduce manufacture costs required for production of an air guide by adjusting shape and size of the air guide for guiding air inhaled by a drying fan.

Another object of the invention is to provide an air flow structure of a dryer, which has excellent air circulation efficiency with improvement of a duct structure of the dryer by suitably controlling a position of the air guide.

In order to accomplish the above object, the present invention provides an air flow structure of a dryer, which includes a drying drum; a back cover mounted to a rear of the drying drum to protect the drying drum; a drying fan mounted to a side of the back cover to inhale circulation air; and an air guide mounted to a position spaced apart from an outer circumference of the drying fan as much as a predetermined distance to guide flow of the circulation air inhaled by the drying fan, the air guide having a bent portion so as to divide the flow of the circulation air into two directions.

In another aspect of the invention, there is provided an air flow structure of a dryer, which includes a back cover; a drying fan mounted to a lower portion of the back cover in order to inhale circulation air discharged from a drying drum; an air guide including a bent portion mounted to a side of the drying fan to divide the circulation air discharged from the drying fan into two parts, a seat rib formed by bending a bottom surface so as to be closely adhered to the back cover, and at least one combination hole formed through the seat rib; and a duct cover for covering the drying fan and the air guide.

In still another aspect of the invention, there is also provided an air flow structure of a dryer, which includes a back cover; a drying fan mounted to a lower portion of the back cover so as to inhale circulation air discharged from a drying drum; an air guide mounted to a side of the drying fan to guide flow of the circulation air discharged by the drying fan; and an air-sealing guide formed to wrap a part of the drying fan so as to prevent the circulation air from being leaked out.

In still another aspect of the invention, there is also provided an air flow structure of a dryer, which includes a drying fan; an air guide having a bent and inclined shape so as to guide flow of circulation air discharged from the drying fan; an air-sealing guide for connecting lower ends of the air guide so that the circulation air is guided upward; a heater in which the circulation air guided by the air-sealing guide is introduced and receives heat; and a drum cover having an introduction hole for the circulation air heated by the heater to be introduced into a drum.

By using the air flow structure of a dryer configured as above according to the present invention, noise generated in the drying duct is reduced and air volume is increased.

In addition, in the present invention, the air guide may have various shapes as desired, and manufacture costs for production of the air guide may be reduced.

BRIEF DESCRIPTION OF THE DRAWINGS

The spirit of the invention and resultant advantages will be more clearly understood with reference to the accompanying drawings. However, the spirit of the invention is limited to the drawings. In the drawings.

DETAILED DESCRIPTION OF THE INVENTION

Hereinafter, a specific embodiment of the present invention is described in detail with reference to the accompanying drawings. However, the spirit of the invention is not limited to the embodiment, but retrograde embodiments and other embodiments within the scope of the invention may be proposed by adding, changing or deleting any component.

Figure 1:
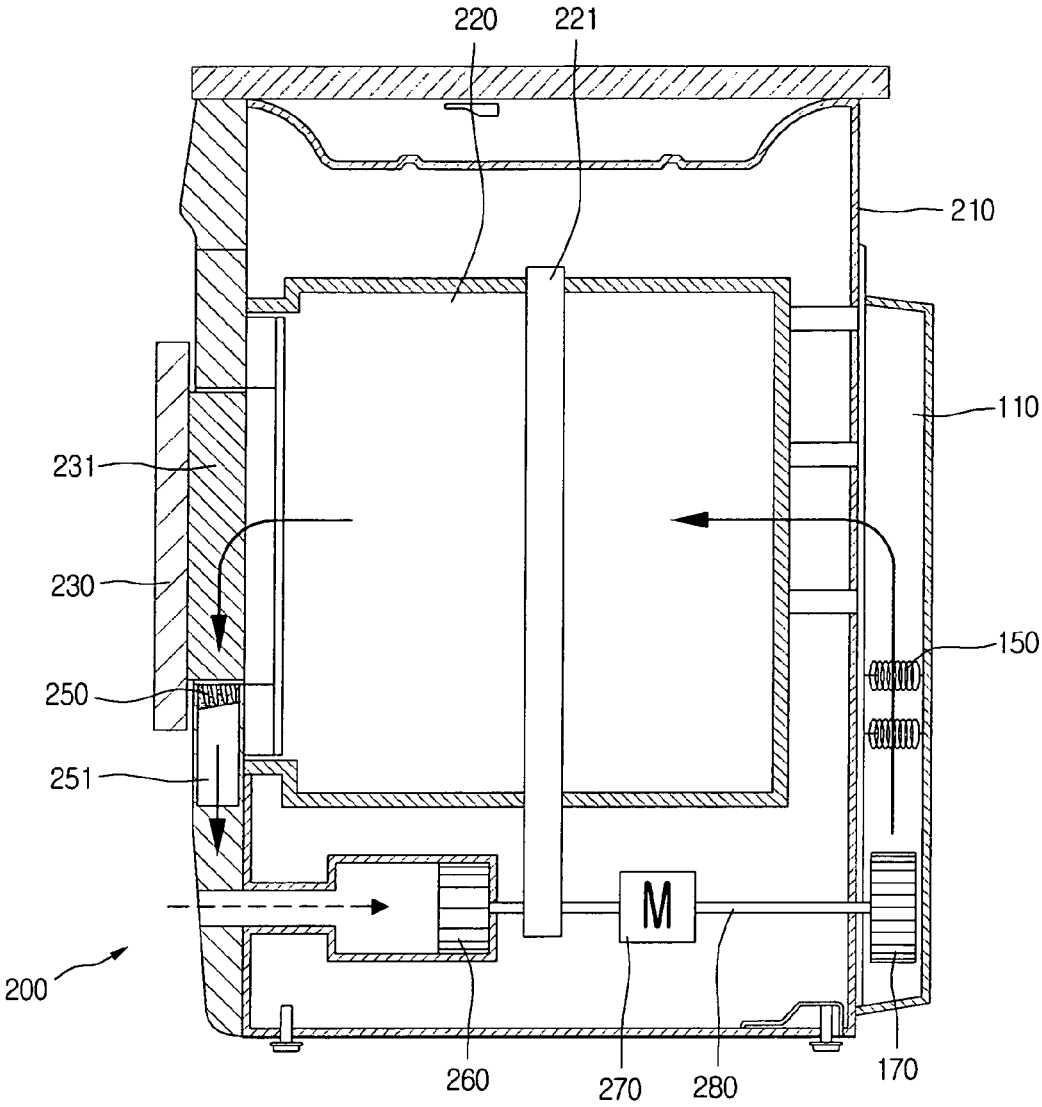
FIG. 1 is a sectional view schematically showing a condensation drum dryer equipped with an air flow structure according to the present invention.
Figure 2:
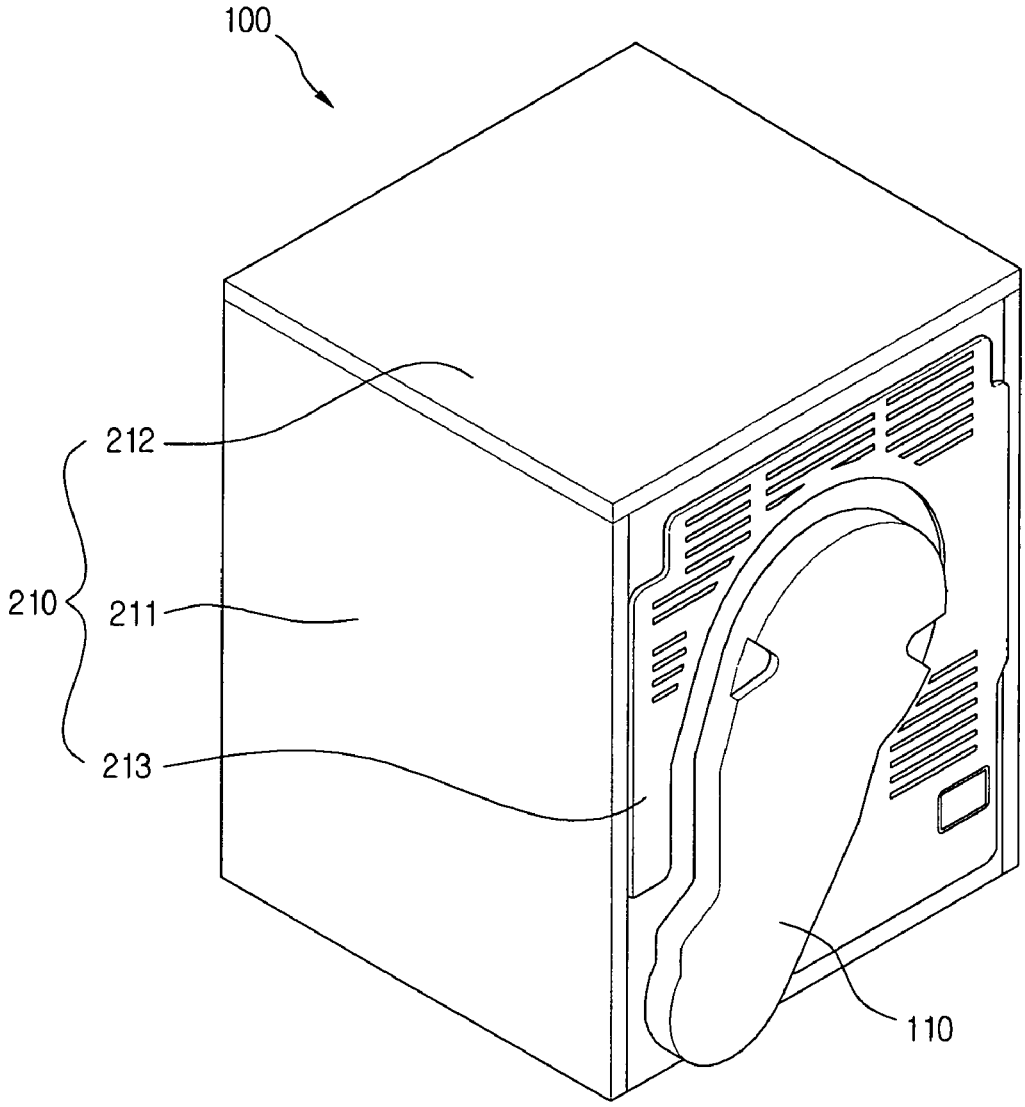
FIG. 2 is a perspective view showing the dryer.

FIG. 1 is a sectional view schematically showing a condensation drum dryer equipped with an air flow structure according to the spirit of the present invention, and FIG. 2 is a perspective view showing the dryer.

Referring to FIGS. 1 and 2, the condensation drum dryer 200 equipped with the air flow structure according to the present invention includes an outer case 210 configuring an appearance of the dryer, a cylindrical drum 220 mounted in the outer case 210 to receive the laundry, a door 230 for controlling opening/closing of the drum 220, and a belt 221 wrapped around the outer circumference of the drum 220 so as to rotate the drum 220.

In detail, the outer case 210 includes an upper cover 211 for protecting an upper portion of the dryer 200, a side cover 212 for protecting sides of the dryer 200, and a back cover 213 for protecting a rear of the dryer 200.

In addition, the condensation drum dryer 200 includes a motor shaft 280 connected to the belt 221 to transfer rotational force to the drum 220, a motor 270 connected to the motor shaft 280 to provide rotational force thereto, and a cooling fan 260 connected to one end of the motor shaft 280 to inhale air with rotating by means of the rotational force received from the motor 270. In addition, the condensation drum dryer 200 includes a drying fan 170 connected to the other end of the motor shaft 280 to circulate air in the drum 220, and a duct cover 170 for connecting the drying fan 170 to a rear of the drum 220 so that the air inhaled by the drying fan 170 may be flowed toward the drum 220. In more detail, the cooling fan 260 and the drying fan 170 are formed at positions faced with each other on the basis of the motor 270. In addition, the drying fan 170 and the heater 150 are received in the duct cover 110, and an air channel is formed in the duct cover 110 so that the circulation air inhaled by the drying fan 170 is flowed to the rear of the drum 220.

In addition, the dryer 200 includes a door lint filter 231 formed in the rear surface of the door 230 to primarily filter impurities such as naps contained in the circulation air departing from the drum 220, and a body lint filter 250 formed below the door lint filter 231 so that the circulation air primarily filtered through the door lint filter 231 is secondarily filtered. In addition, a circulation duct 251 is further included to act as a passage through which the circulation air passing through the body lint filter 250 is flowed toward a condenser 310 (see FIG. 3).

Now, operation of the dryer 200 is described.

First, if power is applied to the dryer 200, the motor 270 rotates and the heater 150 mounted in the duct cover 110 is heated. In addition, the belt 221 connected to the motor shaft 280 is rotated, thereby making the drum 220 rotated. As the drum 220 rotates, the laundry in the drum 220 is ascended along the inner wall of the drum 220, and then falls down due to its weight when it reaches the top portion. Here, the laundry is ascended by means of a lift (not shown) attached to the inner wall of the drum 220.

Meanwhile, the drying fan 170 connected to the motor shaft 280 is rotated together with the motor 270, so the circulation air passing through the condenser 310 is inhaled. In addition, the inhaled air is ascended along the duct cover 110 and then passes through the heater 150 to become a hot and dry air. The hot and dry air absorbs moisture from the laundry while passing in the drum, thereby becoming a hot and humid air.

In addition, the hot and humid air is again filtered by the door lint filter 231 and the body lint filter 250, and then flowed to the condenser 310 along the circulation duct 251.

Meanwhile, as the cooling fan 260 connected to the motor shaft 280 is rotated, an indoor air out of the dryer 200 is inhaled into the dryer 200. The inhaled indoor air is flowed to the condenser 310 through the cooling fan 260. In addition, the hot and humid air and the indoor air just exchange heat, not being mixed due to the configuration of the condenser 310.

Thus, the circulation air in a hot and humid state is deprived of heat by the indoor air and changed into a cool and humid air. In addition, as temperature is lowered, moisture contained in the circulation air is condensed, and the condensed moisture is dropped down onto the bottom of the condenser 310 and then moved to a sump 350 (see FIG. 3) where condensed water is collected.

In addition, the moisture moved to the sump 350 is moved to a condensation water storage (not shown) positioned above the dryer by means of a condensation pump. In addition, the indoor air passing through the condenser 310 takes heat from the hot and humid air so that the hot and humid air is changed into a cool and humid air, and temperature of the indoor air is increased.

Here, the circulation air inhaled by the drying fan 170 is rotated by means of an air guide formed in the duct cover 110 and is moved upward in the duct cover 110 into the drum 220 via the heater 150.

Figure 3:
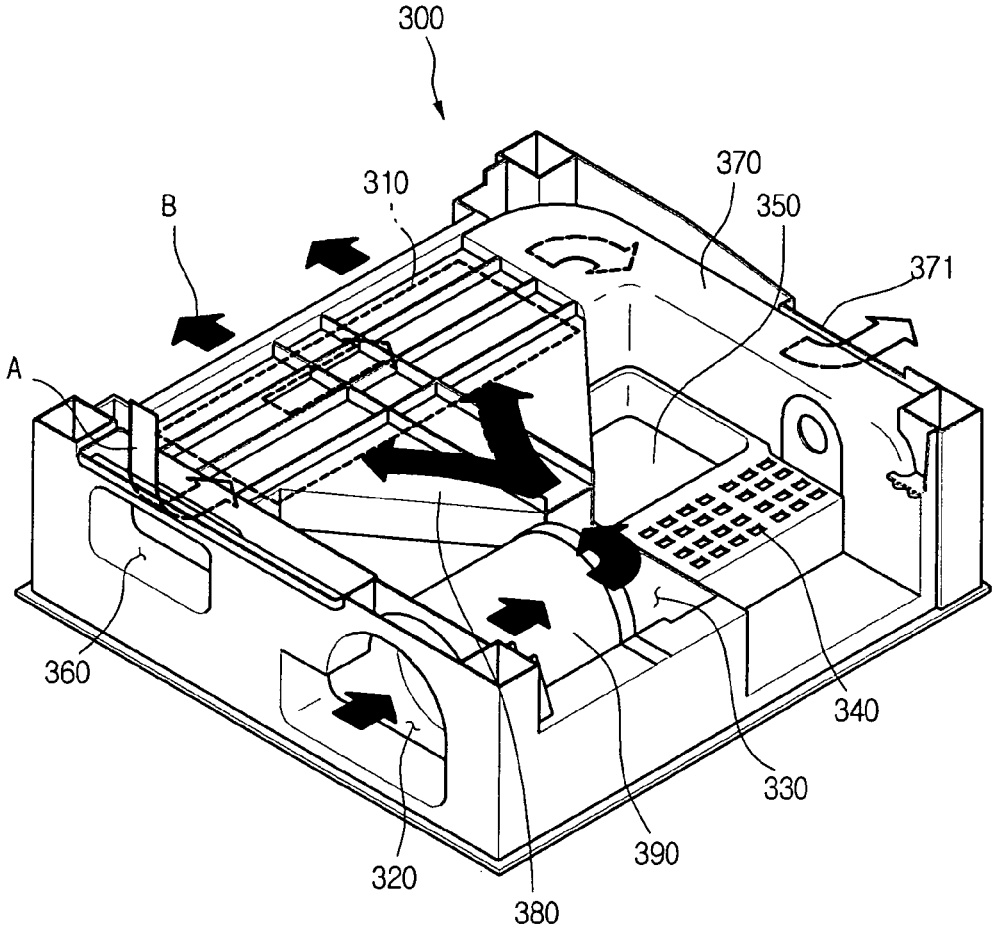
FIG. 3 is a perspective view showing a base structure of the dryer according to the present invention.

FIG. 3 is a perspective view showing a base structure of the dryer according to the spirit of the present invention.

Referring to FIG. 3, the circulation air passing through the drum 220 is flowed along a circulation channel formed in a base 300, and the indoor air inhaled by the cooling fan 260 is also flowed along a channel formed in the base 300.

In detail, the channels for the circulation air (A) and the indoor air (B) are formed in the base 300. It should be noted that shape of the base 300 and location of the channels in the present invention are not limited to the embodiment.

Meanwhile, the base 300 in which the condenser 310 is installed includes a condenser insert hole 360 formed in one side of the front portion of the base 300 so as to act as an entrance for the condenser 310 to be inserted, an indoor air (B) inhaling hole 320 formed at a position in the front portion of the base 300 that is spaced apart from the condenser insert hole 360 as much as a predetermined distance, a blower 390 for inhaling the indoor air (B) through the indoor air (B) inhaling hole 320, and a cooling fan seat groove 330 formed at an end of the blower 390.

In addition, the base 300 includes a condensation duct 380 extended a predetermined length from the cooling fan seat groove 330 and formed in a substantially perpendicular direction to the blower 390, and a circulation air (A) channel 370 through which the circulation air (A) passing through the condenser 310 by moving along the condensation duct 380 is flowed.

In more detail, an end of the condensation duct 380 is connected to the condenser 310, and the drying fan 170 is mounted in the end portion of the circulation air (A) channel 370. In addition, a drying duct connector 371 connected to a lower end of the duct cover 110 is formed at an end of the circulation air (A) channel 370. In addition, a motor seat 340 for the motor 270 to be seated is formed between the cooling fan seat groove 330 and the drying duct connector 371. In addition, the sump 350 for storing condensation water generated in the condenser 310 is formed in a substantial center portion of the base 300.

To describe flow of fluid in the base 300 configured as mentioned above, the circulation air (A) passing through the drum 220 and the lint filters 231 and 250 is flowed toward the condenser 310 mounted in the base 300. In addition, temperature of the circulation air (A) is lowered by means of heat exchange while the circulation air (A) passes through the condenser 310, thereby generating condensation water. In addition, the circulation air (A) changed into a cool and dry state with passing through the condenser 310 is flowed along the circulation air (A) channel 370. In addition, the cool and dry circulation air is ascended along a drying channel formed in the duct cover 110. In addition, the cool and dry circulation air is heated by the heater 150 mounted therein while being ascended along the drying channel. In addition, the circulation air (A) changed into a hot and dry state by heat from the heater 150 is flowed again into the drum, thereby completing its circulation.

Meanwhile, the indoor air (B) that exchanges heat with the circulation air (A) is introduced into the blower 390 through the indoor air (B) inhaling hole 320. Here, the indoor air (B) 9*s* introduced into the blower 390 by means of the cooling fan 260 mounted in the cooling fan seat groove 330.

In more detail, the indoor air (B) inhaled by the cooling fan 260 is flowed toward the condenser 310 through the condensation duct 380. And then, the indoor air (B) exchanges heat with the circulation air (A) with passing through the condenser 310, thereby increasing its temperature.

Figure 4:
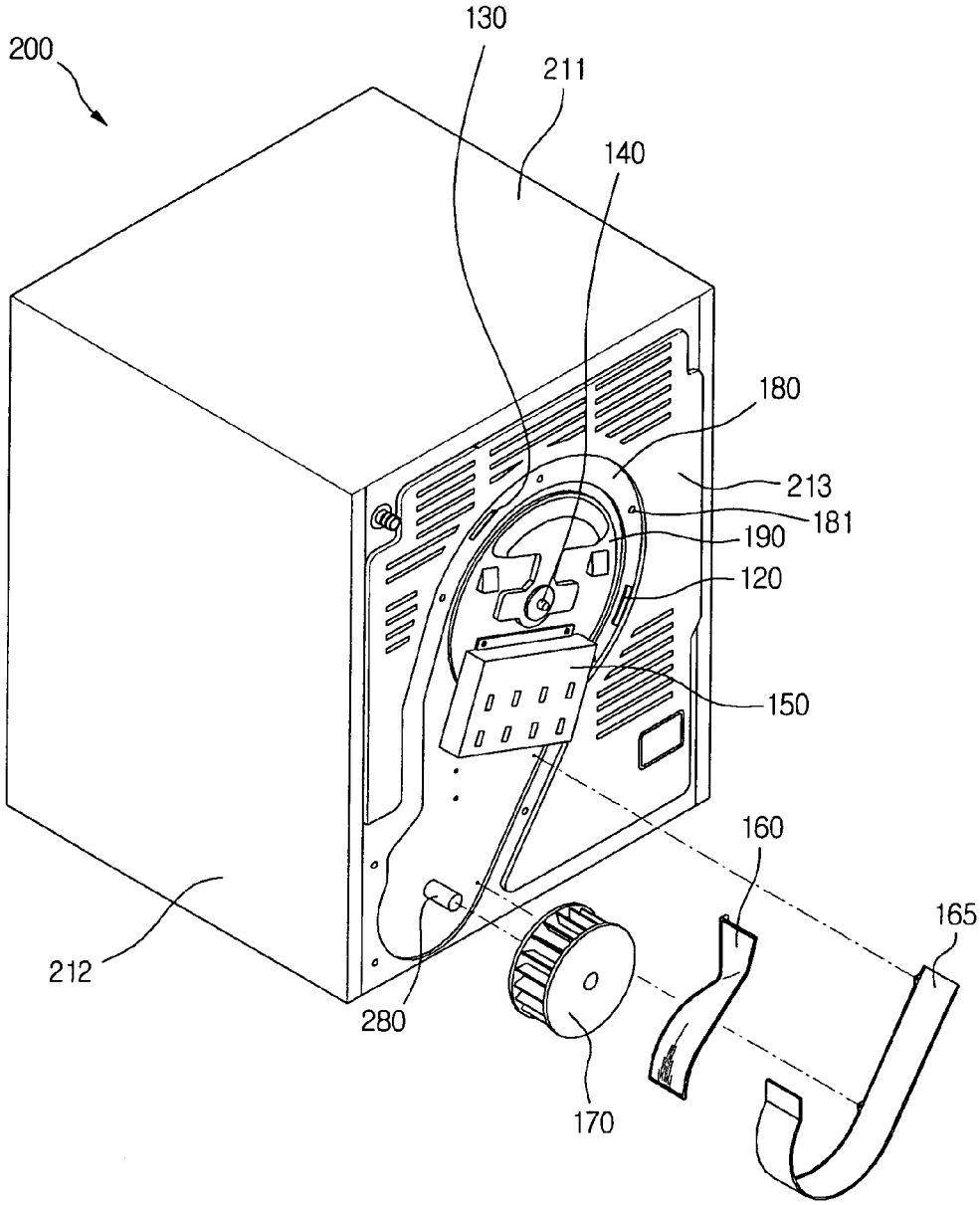
FIG. 4 is an exploded perspective view showing a duct structure of the dryer according to the present invention.

FIG. 4 is an exploded view showing a duct structure of the dryer according to the spirit of the present invention.

Referring to FIG. 4, the dryer 100 having a duct structure according to the spirit of the present invention includes a back cover 213, and a duct cover 110 attached to the back cover 213.

In addition, in the duct structure, there are included a duct cover seat face 180 recessed a predetermined depth according to the shape of the duct cover, and a drum cover 190 formed in the duct cover seat face 180 to cover a rear side of a drum (not shown).

In addition, the duct structure includes a journal bearing shaft 140 passing through the center of the drum cover 190 to support the drum, a heater 150 mounted in a substantially lower portion of the drum cover 190 to increase temperature of the circulation air, and a drying fan 170 provided to a lower edge of the back cover 213 to inhale the circulation air that is changed into a cool and dry state with passing through the condenser 310.

In addition, the duct structure includes an air guide 160 seated on one side of the outer circumference of the drying fan 170 and mounted to the duct cover seat face 180 by means of a combination member, and an air-sealing guide 165 surrounding the outer circumference of the air guide 160 and having a shape identical to a shape of the lower portion of the duct cover 110 so as to prevent the air inhaled by the drying fan 170 from being leaked below the duct cover 110.

Hereinafter, functions and actions of inner components of the duct are described.

The cool and dry circulation air passing through the condenser 310 is inhaled by the drying fan 170, and the inhaled air is rotated in a counterclockwise direction along the inner wall of the air guide 160. Here, since the drying fan 170 is a cross flow fan in which air is inhaled in an axial direction and discharged in a radial direction, the inhaled air is collided with the inner wall of the air guide 160 provided at a side of the drying fan 170.

Meanwhile, the circulation air that is rotating along the inner wall of the air guide 160 is flowed above the duct cover 110 along the inner wall of the air-sealing guide 165. In addition to that, the air-sealing guide 165 prevents the circulation air from being leaked out of the duct cover 110. In addition, the circulation air flowed above the duct cover 110 receives heat with passing through the heater 150.

In addition, the circulation air changed into a hot and dry state with receiving heat is flowed to a drum rear wall communicated with the duct cover 110, and then entered into the drum through a plurality of through holes formed in the drum rear wall. In addition, the circulation air entered into the drum 220 evaporates moisture remained in the laundry, and then changed into a hot and humid state.

Figure 5:
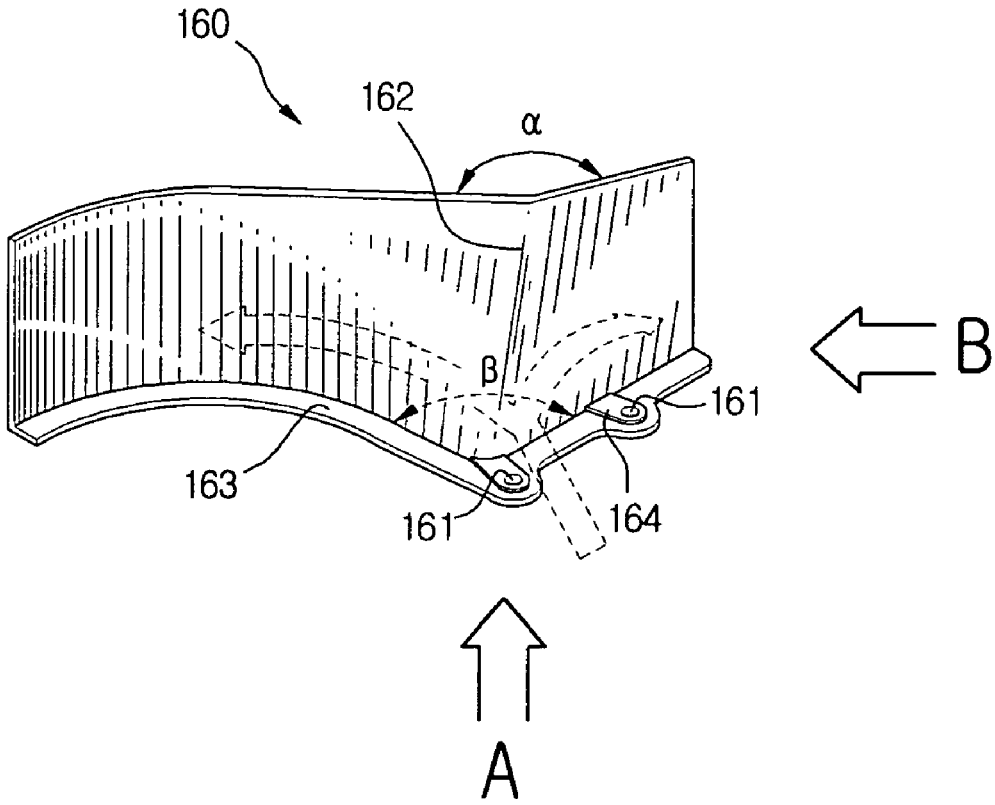
FIG. 5 is a perspective view showing an air guide of the dryer according to the present invention.
Figure 6:
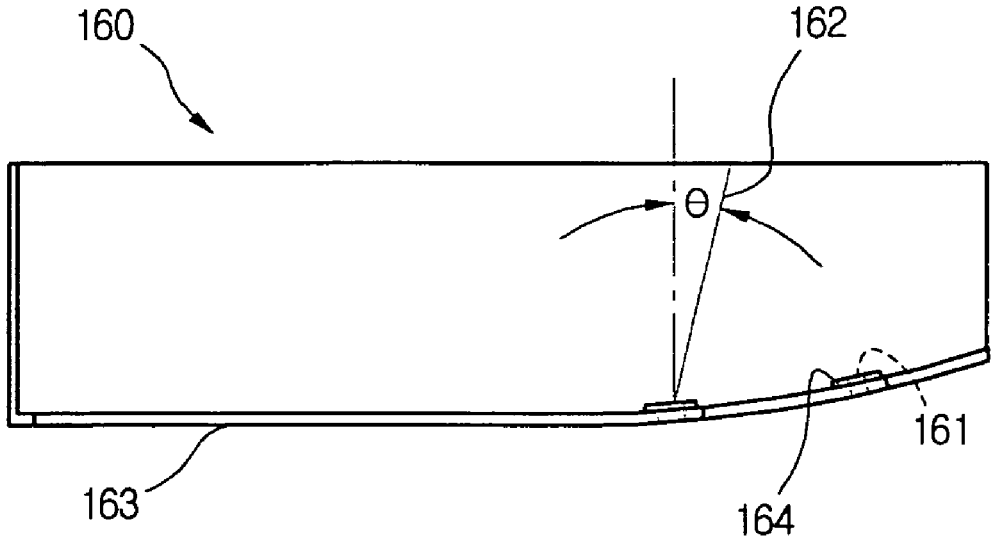
FIG. 6 is a front view showing the air guide, seen in A direction of FIG. 5.
Figure 7:
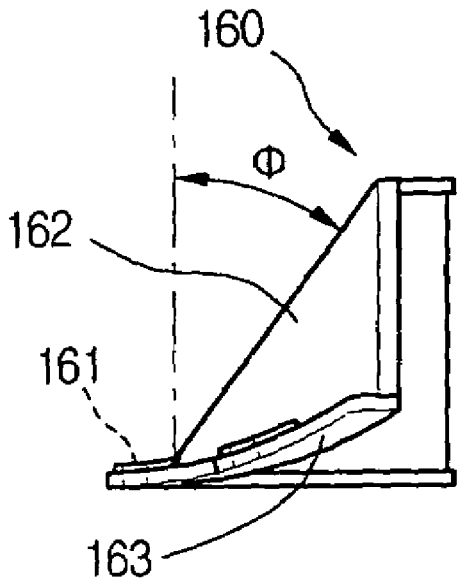
FIG. 7 is a side view showing the air guide, seen in B direction of FIG. 5.

FIG. 5 is a perspective view showing an air guide according to the spirit of the present invention, FIG. 6 is a front view showing the air guide, seen in A direction of FIG. 5, and FIG. 7 is a side view showing the air guide, seen in B direction of the FIG. 5.

Referring to FIGS. 5 to 7, the air guide 160 according to the present invention is seated on a side of the drying fan 170.

In detail, the air guide 160 includes a seat rib 163 bent at a lower end according to the shape of the air guide 160, and a combination hole 161 formed through the seat rib 163 so that a combination member for combination with the back cover 213 may be inserted therein. In addition, an anti-wear projection 164 stepped slightly higher than the seat rib 163 is formed on the seat rib 163 at a portion where the combination hole 161 is formed. Thus, the anti-ware projection 164 prevents wear caused when the seat rib 163 is directly contacted with a heat portion of the combination member that passes through the combination hole 161.

Meanwhile, the air guide 160 is preferably rounded with a shape capable of minimizing frictional force with the circulation air discharged in a radial direction of the drying fan 170.

In detail, the air guide 160 has a bent portion 162 so that the air passing through the drying fan 170 is divided into two directions. In addition, on the basis of the bent portion 162, the air passing through the drying fan 170 is partially flowed upward, and the rest of the air is rotated in a counterclockwise direction and then flowed downward smoothly. In addition, the combination hole 161 is preferably formed only at a portion above the seat rib 163 on the basis of the bent portion 162 so that the air guide 160 may be detachable freely. In addition, in order to decrease noise generated by the circulation air that flows along the air guide 160, the air guide 160 preferably has a size capable of wrapping a part of the drying fan 170.

In addition, the air guide 160 is inclined as much as a predetermined angle ($\phi$) to a rear side on the basis of a vertical line passing through the seat rib 162 as shown in FIG. 7. Thus, the noise generated when the circulation air discharged in a radial direction of the drying fan 170 is collided with the surface of the air guide 160 may be remarkably reduced. In detail, if the inclined angle ($\phi$) is suitably controlled so that the period of noise generated by collision between the circulation air and the air guide 160 is alternated, the noise may be considerably reduced to about 2 dB.

In addition, the bent portion 162 of the air guide 160 is inclined upward as much as a predetermined angle ($\theta$) on the basis of the vertical line passing through the seat rib 163 as shown in FIG. 6. Thus, most of the circulation air that is discharged in a radial direction of the drying fan 170 and rotated in a counterclockwise direction is naturally flowed below the bent portion 162, thereby reducing flow loss.

In addition, in order to decrease flow loss and noise generated by contact between the air guide 160 and the circulation air discharged from the drying fan 170, a bent angle ($\alpha$) of the surface of the air guide 160 that is formed at the upper end of the bent portion 162 is greater than a bent angle (β) of the surface of the air guide 160 that is formed at the lower end of the bent portion 162.

In addition, the air guide 160 is a plastic injection mold, not a metal plate used in the prior art, so that a shape of the air guide 160 may be freely selected, thereby increasing air volume and reducing noise.

Figure 8:
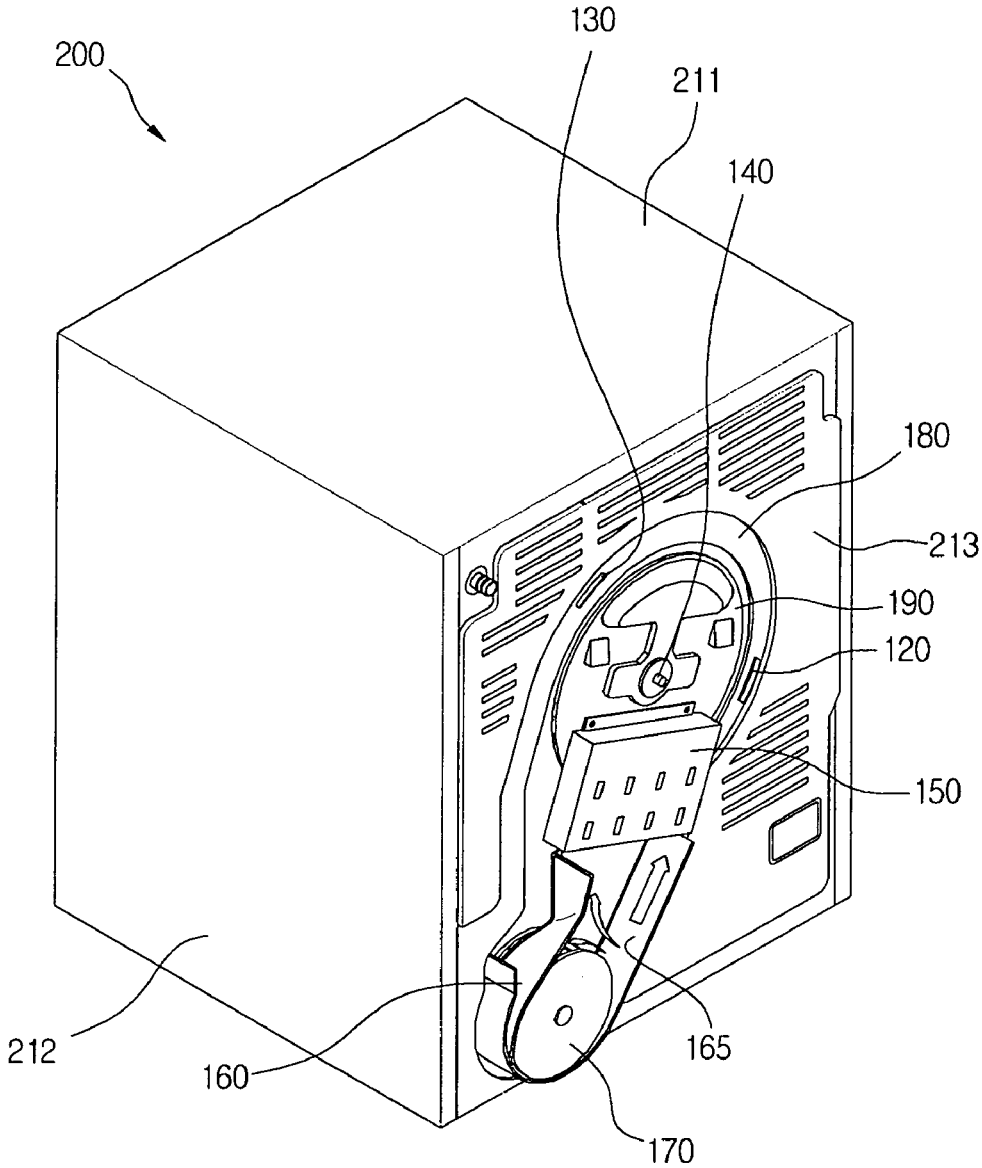
FIG. 8 is a perspective view showing flow of circulation air in the duct of the dryer according to the present invention.

FIG. 8 is a perspective view showing flow of the circulation air generated in the duct of the dryer according to the spirit of the present invention.

Referring to FIG. 8, the circulation air inhaled by the drying fan 170 is discharged in a radial direction of the drying fan 170. In addition, the discharged circulation air is flowed along the inner surface of the air guide 160.

As mentioned above, the circulation air is partially flowed down and partially flowed up on the basis of the bent portion 162 of the air guide 160.

In detail, the part of circulation air flowed upward is introduced into the heater 150, and the part of the air flowed downward is rotated in a counterclockwise direction along the inner circumference of the air guide 160. In addition, the air is flowed up along the inner circumference of the air-sealing guide 165 that is mounted out of the air guide 160 and configures a lower portion of the duct. In addition, the circulation air flowing along the air-sealing guide 165 is flowed into the heater 150, receives heat, and is then flowed into the drum 220 through a rear wall of the drum 220.

What is claimed is:

1. An air flow structure of a dryer, comprising:

a drying drum;

a back cover mounted to a rear of the drying drum to protect the drying drum;

a drying fan mounted to a side of the back cover to inhale circulation air; and an air guide mounted to a position spaced apart from an outer circumference of the drying fan as much as a predetermined distance to guide flow of the circulation air inhaled by the drying fan, the air guide having a bent portion so as to divide the flow of the circulation air into two directions.

2. The air flow structure of a dryer according to claim 1, wherein the bent portion is located at a position closer to an upper end of the air guide.

3. The air flow structure of a dryer according to claim 1, wherein the bent portion is inclined to a rear side as much as a predetermined angle (ϕ) on the basis of an rotary shaft of the drying fan.

4. The air flow structure of a dryer according to claim 1, wherein the bent portion is inclined upward as much as a predetermined angle (θ) on the basis of a rotary shaft of the drying fan.

5. The air flow structure of a dryer according to claim 1, wherein a bent angle (α)) of a surface of the air guide that is located at an upper end of the bent portion is greater than a bent angle (β) of a surface of the air guide that is located at a lower end of the bent portion.

6. The air flow structure of a dryer according to claim 1, wherein the air guide comprises an injection-molded plastic.

7. An air flow structure of a dryer, comprising:

a back cover;

a drying fan mounted to a lower portion of the back cover in order to inhale circulation air discharged from a drying drum;

an air guide including a bent portion mounted to a side of the drying fan to divide the circulation air discharged from the drying fan into two parts, a seat rib having a bent bottom so as to be closely adhered to the back cover, and at least one combination hole through the seat rib; and a duct cover for covering the drying fan and the air guide.

8. The air flow structure of a dryer according to claim 7, wherein the combination hole is located in an upper portion on the basis of the bent portion so that the air guide is easily detachable from the back cover.

9. The air flow structure of a dryer according to claim 7, wherein the seat rib has an anti-wear projection stepped with a predetermined height at a position where the combination hole is located.

10. The air flow structure of a dryer according to claim 7, further comprising an air-sealing guide wrapped about a part of the air guide so that the circulation air flowed down along a surface of the air guide is guided into the drying drum.

11. An air flow structure of a dryer, comprising:

a back cover;

a drying fan mounted to a lower portion of the back cover so as to inhale circulation air discharged from a drying drum;

an air guide mounted to a side of the drying fan to guide flow of the circulation air discharged by the drying fan; and an air-sealing guide wrapped about a part of the drying fan so as to prevent the circulation air from being leaked out.

12. The air flow structure of a dryer according to claim 11, wherein the drying fan is a cross flow fan for inhaling the circulation air in an axial direction and then discharging the circulation air in a radial direction.

13. The air flow structure of a dryer according to claim 11, wherein the air guide has a bent portion that is bent so that the circulation air discharged in a radial direction of the drying fan is partially introduced directly into a heater and partially rotated in a rotating direction of the drying fan.

14. The air flow structure of a dryer according to claim 11, wherein the air guide wraps only a part of the drying fan.

15. The air flow structure of a dryer according to claim 11, wherein the air guide has a streamlined shape so that noise generated by collision against the circulation air is reduced.

16. The air flow structure of a dryer according to claim 13, wherein a lower end of the air guide is longer than an upper end on the basis of the bent portion.

17. The air flow structure of a dryer according to claim 11, wherein the air guide is detachable from the back cover.

18. The air flow structure of a dryer according to claim 13, wherein the bent portion is inclined upward so that a greater amount of the circulation air discharged from the drying fan is flowed down on the basis of the bent portion.

19. An air flow structure of a dryer, comprising:

a drying fan;

an air guide having a bent and inclined shape so as to guide flow of circulation air discharged from the drying fan;

an air-sealing guide for connecting lower ends of the air guide so that the circulation air is guided upward;

a heater in which the circulation air guided by the air-sealing guide is introduced and receives heat; and a drum cover having an introduction hole for the circulation air heated by the heater to be introduced into a drum.

20. The air flow structure of a dryer according to claim 19, wherein the circulation air is partially flowed up along a bent surface of the air guide and then introduced into the heater, and the circulation air is partially flowed down, changes its direction upward along an inner circumference of the air-sealing guide and is then introduced into the heater.

* * * * *